US006335099B1

(12) United States Patent
Higuchi et al.

(10) Patent No.: US 6,335,099 B1
(45) Date of Patent: Jan. 1, 2002

(54) CORROSION RESISTANT, MAGNESIUM-BASED PRODUCT EXHIBITING LUSTER OF BASE METAL AND METHOD FOR PRODUCING THE SAME

(75) Inventors: Tsutomu Higuchi; Mitsuo Suzuki; Makoto Dobashi, all of Saitama (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 0 days.

(21) Appl. No.: 09/403,503

(22) PCT Filed: Feb. 23, 1999

(86) PCT No.: PCT/JP99/00792

§ 371 Date: Oct. 22, 1999

§ 102(e) Date: Oct. 22, 1999

(87) PCT Pub. No.: WO99/42641

PCT Pub. Date: Aug. 26, 1999

(30) Foreign Application Priority Data

Feb. 23, 1998 (JP) ..... 10-40187
Mar. 18, 1998 (JP) ..... 10-69128

(51) Int. Cl.[7] ..... B32B 15/04; C25D 11/30

(52) U.S. Cl. ..... 428/469; 428/472.2; 428/472.3; 205/316; 205/318; 205/321; 205/333

(58) Field of Search ..... 428/469, 472.2, 428/472.3; 205/321, 316, 318, 333

(56) References Cited

U.S. PATENT DOCUMENTS 5,266,412 A * 11/1993 Bartak et al. ..... 428/472
5,811,194 A * 9/1998 Kurze et al. ..... 428/469
6,051,322 A * 4/2000 Kakizaki et al. ..... 428/472

FOREIGN PATENT DOCUMENTS

| | | |
|---|---|---|
| FR | 903193 | 9/1945 |
| GB | 825458 | 12/1959 |
| GB | 829716 | 3/1960 |
| JP | 49-122443 | 11/1974 |
| JP | 56 098495 | 8/1981 |
| JP | 60-218497 | 11/1985 |
| JP | 61-34200 | 2/1986 |
| JP | 62-70600 | 4/1987 |
| JP | 63-250498 | 10/1988 |
| JP | 9-176894 | 7/1997 |
| JP | 10-219496 | 8/1998 |
| WO | WO 9628591 | 9/1996 |

* cited by examiner

*Primary Examiner*—Blaine Copenheaver
*Assistant Examiner*—Jennifer McNeil
(74) *Attorney, Agent, or Firm*—Young & Thompson

(57) ABSTRACT

A corrosion-resistant article of a magnesium material having the gloss of the metal substrate surface comprises an anodic oxide film formed on the external surface of an article of magnesium or a magnesium alloy, which never changes the gloss of the metal substrate and a colorless or colored transparent electrodeposition coating film on the anodic film. Such an article can be prepared by immersing an article of magnesium or a magnesium alloy in an electrolyte containing a phosphate and an aluminate to thus form an anodic oxide film through anodization of the surface of the article and forming a colorless or colored transparent electrodeposition coating film on the anodic film through electrodeposition coating.

14 Claims, No Drawings

CORROSION RESISTANT, MAGNESIUM-BASED PRODUCT EXHIBITING LUSTER OF BASE METAL AND METHOD FOR PRODUCING THE SAME

TECHNICAL FIELD

The present invention relates to a corrosion resistant article of a magnesium material (in this description, both magnesium and magnesium alloys will hereinafter be comprehensively referred to as "magnesium material") having metallic substrate gloss and a method for preparing the article and more specifically to a corrosion resistant article of a magnesium material having metallic substrate gloss, which has an anodic oxide film on the outer surface of an article of magnesium material and has a colorless or colored transparent electrodeposition coating film on the anodic oxide film as well as a method for preparing a corrosion resistant article of a magnesium material having metallic substrate gloss which comprises the steps of forming an anodic oxide film on a substrate of a magnesium material by anodization using an electrolyte having a novel composition and then forming, on the anodic film, a colorless or colored transparent electrodeposition coating film by electrodeposition technique.

BACKGROUND ART

Among the practically used metals, the magnesium materials are the lightest ones and also have high specific strength and therefore, there have been tried to apply them in various fields such as interior and exterior parts for motor cars and two-wheeled vehicles, parts for household appliances, containers for storage such as bags and suitcases, goods for sports, parts for optical machinery and tools, sticks and further new fields in electronic industries such as computers and acoustics or they have been put into practical use. However, the magnesium materials, among practically used metals, are the most active metal materials and accordingly, it has been difficult to use them per se without any treatment because of their low corrosion resistance.

As surface-treating methods for improving the corrosion resistance of the magnesium materials, there have conventionally been used, for instance, chemical conversion treatments, anodization treatments and coating and plating techniques. In particular, a relatively uniform film is formed on a substrate surface, if the surface is first anodized to form an anodic oxide film and then subjected to a sealing treatment, and thus such treatments have been used for a rust-proofing treatment or a surface treatment for coating.

When imparting decorative properties to articles of magnesium materials while making the most use of the gloss and color tone of the metal substrate surface thereof, the surface of the articles cannot be subjected to coating. However, the surface of the magnesium material is highly susceptible to oxidation and therefore, the article should be subjected to any surface treatment to maintain the initial gloss and color tone of the metal substrate surface thereof.

The film obtained through the conventional chemical conversion treatment or anodization treatment using chromic acid or a bichromate gets colored white or brown or black or further green. Moreover, even a film obtained by an anodization treatment without using any chromic acid or bichromate may ensure corrosion resistance. In this case, however, the resulting anodic oxide film should have a thickness of not less than several micrometers to ensure the desired corrosion resistance and for this reason, the surface obtained after the anodization treatment is inevitably dimmed or colored.

For instance, Japanese Un-Examined Patent Publication No. Hei 9-176894 discloses a surface-treating method comprising the step of forming an anodic oxide film using, as an electrolyte, an aqueous solution which comprises at least one member selected from the group consisting of hydroxides, carbonates and bicarbonates of alkali metals or alkaline earth metals and to which a film-forming stabilizer is added and the patent also describes that the color tone of the anodic oxide film sometimes provides the color of the substrate surface per se. In the method for forming an anodic oxide film disclosed in this patent, however, the anodic film gets colored when it is formed in a thickness required for achieving desired corrosion resistance.

As an alternative surface-treating method capable of maintaining the gloss and color tone of the substrate surface of the magnesium material, there has also been known a method in which an organic clear coating is electrodeposition-coated. However, the formation of an organic coating film inevitably causes changes in the gloss and color tone of the metal substrate and the surface thereof often becomes dim.

Accordingly, it is an object of the present invention to provide an article of a magnesium material which can eliminate the problems associated with the conventional anodic oxide film and clear coating film or which has the gloss and color tone of the metal substrate surface of the magnesium material or which has the gloss of the metal substrate while the color tone thereof is slightly changed and which is excellent in corrosion resistance.

It is another object of the present invention to provide a method for preparing a corrosion-resistant article of a magnesium material having the gloss of the metal substrate surface, which comprises the steps of forming an anodic oxide film on the surface of an article of a magnesium material and then forming, on the anodic film, a colorless or colored transparent electrodeposition coating film.

DISCLOSURE OF THE INVENTION

The inventors of this invention have found that a highly corrosion-resistant, thin and colorless transparent anodic oxide film which have never been achieved can be obtained by anodization of an article of a magnesium material using an electrolyte which makes use of a combination of a phosphate, conventionally used as a film-forming stabilizer when anodizing a metal, and an aluminate and that an article of a magnesium material whose corrosion resistance is further improved can be obtained by forming a colorless or colored transparent electrodeposition coating film on the anodic film and have thus completed the present invention based on these findings.

Accordingly, the corrosion-resistant article of a magnesium material having the gloss of the metal substrate surface, according to the present invention, comprises an anodic oxide film formed on the external surface of an article of a magnesium material, which never changes the gloss of the metal substrate and a colorless or colored transparent electrodeposition coating film on the anodic film.

Moreover, the method for preparing a corrosion-resistant article of a magnesium material having the gloss of the metal substrate surface, according to the present invention, comprises the steps of immersing an article of a magnesium material in an electrolyte containing a phosphate and an aluminate and an optional bath stabilizer consisting of a hydroxyl group-containing organic compound to thus form an anodic oxide film through anodization of the surface of the article, thereafter optionally immersing the anodized article in hot water to subject it to a sealing treatment and forming a colorless or colored transparent electrodeposition coating film on the anodic film through electrodeposition.

THE BEST MODE FOR CARRYING OUT THE INVENTION

The article of a magnesium material used in the present invention may be made of any magnesium material. Examples of such materials are magnesium alloys such as Mg—Al alloys, Mg—Al—Zn alloys, Mg—Al—Mn alloys, Mg—Zn—Zr alloys, Mg-rare earth element alloys and Mg—Zn-rare earth element alloys; and elemental magnesium. In the present invention, the article of a magnesium material may have any surface condition prior to the anodization treatment and thus have such surface conditions as a mirror-finished surface through polishing and a diecast metal surface.

When an anodic oxide film is formed on an article of a magnesium material according to the present invention, the article is subjected to a pre-treatment before the anodization treatment. For the article having such a diecast metal surface, this pre-treatment may be a variety of known treatments, which have conventionally been used prior to the anodization treatment of magnesium materials, such as a treatment with a pyrophosphate and a treatment with a caustic alkali. On the other hand, for the article having specular gloss, the article should be subjected to a mirror-finishing treatment and then to a pre-treatment which does not cause any dissolution of the polished surface (or does not impair the gloss thereof). Examples of such pre-treatments are preferably washing by a treatment with a surfactant, a treatment with an alkali, or combination thereof.

As the phosphates used when an anodic oxide film is formed according to the present invention, there may be listed, for instance, alkali metal salts, alkaline earth metal salts and ammonium salts of phosphoric acid. These phosphates per se may be added to the electrolyte or phosphoric acid and an alkali metal hydroxide, an alkaline earth metal hydroxide, or ammonium hydroxide may be added separately to the electrolyte to form each corresponding phosphate in the electrolyte.

Regarding the concentration of the phosphate in the electrolyte, if it is too low, the electrolysis is apt to be unstable or the resulting anodic oxide film is liable to become dim, i.e., the anodic oxide film is not formed stably. On the other hand, if the concentration of the phosphate is too high, there would be observed such a tendency that it is difficult to form an anodic oxide film having desired characteristic properties. Thus, in the present invention, the concentration of the phosphate in the electrolyte preferably falls within the range of from 0.05 to 0.2 M.

As the aluminates used in the present invention when anodic oxide film is formed, there may be listed, for instance, alkali metal salts, alkaline earth metal salts and ammonium salt. With respect to the concentration of the aluminate in the electrolyte, if it is too low, the electrolysis is apt to be unstable or the resulting anodic oxide film is apt to have insufficient corrosion resistance, while if the concentration is too high, the aluminate has a tendency to undergo hydrolysis to thus form precipitates. For this reason, it is thus preferred, in the present invention, to adjust the concentration of the aluminate in the electrolyte to the range of from 0.2 to 1 M.

The bath stabilizers optionally used in the present invention when forming the anodic oxide film may be a hydroxyl group-containing organic compound which has been known to inhibit any hydrolysis of the aluminate, with polyhydric alcohols such as glycerin and diethylene glycol being preferably used. When the bath stabilizer is used, the concentration thereof in the electrolyte preferably ranges from 1 to 20 g/l or 10 to 50% by weight on the basis of the total weight of the aluminate. If the concentration of the bath stabilizer is less than 1 g/l or less than 10% by weight on the basis of the total weight of the aluminate, the bath stabilizer has a tendency that any satisfactory effect of the addition thereof cannot be ensured, while if the concentration thereof exceeds 20 g/l or 50% by weight on the basis of the total weight of the aluminate, the stabilizer may adversely affect the corrosion resistance of the resulting anodic oxide film.

The pH value of the electrolyte used in the present invention when forming an anodic oxide film is preferably not less than 12. This is because if the pH value is less than 12, there is observed such a tendency that the electrolysis cannot easily proceed. It is preferred to, if necessary, add an alkali substance to the electrolyte so that the pH of the electrolyte is not less than 12, since the pH of the electrolyte varies depending on the concentrations of the phosphate and aluminate.

In addition, if the temperature of the electrolyte is too high, the electrolysis is apt to be unstable or the resulting anodic oxide film is liable to become dim. Therefore, the temperature of the electrolyte is preferably adjusted to the range of from room temperature to 50° C.

The power source used in the present invention when forming an anodic oxide film may be any power sources such as DC power sources, AC power sources, PR power sources and pulse power sources, but DC power sources or AC power sources are generally used.

In respect of the voltage of these power sources, if it is less than 30 V, it is difficult to form an anodic oxide film, while if it exceeds 100 V for the DC power source and 70 V for the AC power source, the electrolysis is liable to be unstable. Therefore, the voltage of the power sources is preferably not more than 90 V for the DC power source and not more than 65 V for the AC power source.

The film formed by the anodization treatment includes a large number of fine pores and therefore, the anodic oxide film is preferably subjected to a sealing treatment in order to further improve the corrosion resistance of the film. In the present invention, the article of a magnesium material may, if necessary, be subjected to a sealing treatment by immersing it in hot water according to any known method, after the anodization treatment. The hot water to be used is preferably pure water maintained at a temperature of not less than 85° C. and the time for the sealing treatment preferably ranges from about 3 to 15 minutes.

In case of the anodic oxide film formed according to the conventional techniques, the film should have a thickness ranging from 1 $\mu$m to several tens $\mu$m in order to ensure desired corrosion resistance and this in turn leads to the formation of an anodic oxide film which gets colored white or brown or black, or further green. Contrary to this, the anodic oxide film formed by the foregoing method for forming such an anodic oxide film is quite dense and accordingly, the film is excellent in corrosion resistance while the thickness thereof is very thin. For instance, the anodic oxide film exhibits sufficient corrosion resistance even if the film has a thickness which does not cause any change of the gloss and color tone of the metal substrate surface, preferably not more than 0.1 $\mu$m. In other words, the present invention permits the formation of an anodic oxide film having excellent corrosion-resistant surface without accompanying almost no change in the gloss and color tone of the metal substrate of the magnesium material.

The thickness and uniformity of the anodic oxide film formed by the foregoing method can easily be evaluated by at least partially depositing platinum vapor, preferably depositing platinum vapor by the ion sputtering technique on the anodic film formed on the external surface of magnesium or magnesium alloy article and examining the color of the vapor-deposited portion. More specifically, the color of the anodic film observed after the platinum vapor-deposition is changed to sky blue-blue-purple depending on the thickness of the film. Therefore, the thickness of the anodic film can be evaluated by confirming the color developed, while the uniformity of the thickness of the film may be assessed by confirming the presence of irregularity of the color. This technique is useful in the production process control and the quality control.

Incidentally, in the foregoing evaluation method, the color of the anodic film is also changed depending on the kind of additives such as phosphates and aluminates present in the electrolyte used in the anodization and therefore, the foregoing evaluation method may likewise be used as a method for assessing the anodic film-forming methods or a coloring method for decoration of articles. For instance, the anodic film gets colored blue when the anodization is carried out using an electrolyte containing a phosphate and an aluminate, while the film gets colored sky blue-blue-purple when the anodization is carried out using an electrolyte containing an aluminate. This phenomenon is caused by the interference of light due to the presence of a platinum vapor-deposited film on the anodic film (thickness: about 40 to 80 nm) on the basic material (magnesium material).

The foregoing method for judgment can be carried out by, for instance, ion-sputtering elemental platinum using, as an ion-sputtering device, IB-5 Type Ion-Coater available from Eiko. Engineering Co., Ltd. and platinum as a metal for vapor-deposition, while the ion-current, vapor-deposition time and degree of vacuum are set at 3 mA, 3 minutes and 0.1 Torr, respectively.

The present invention permits the production of an article of a magnesium material having further improved corrosion resistance and the gloss and color tone of the metal substrate surface by forming a colorless transparent electrodeposition coating film on the anodic oxide film described above; or permits the production of such an article having further improved corrosion resistance and slightly changed color tone of the metal substrate surface by forming a colored transparent electrodeposition coating film on the anodic film.

The foregoing electrodeposition coating film can be obtained by any well-known anionic or cationic electrodeposition coating method. The shape of the electrodeposition coating bath, the kinds of electrodeposition coating liquid, the concentration, temperature and pH of the electrodeposition coating liquid, the electrodeposition coating voltage, the electrodeposition coating time or the like, used in practicing such electrodeposition coating method are well-known in the art and such a well-known technique may be used in the present invention without any modification. For instance, examples of anionic electrodeposition coating liquids include acrylic type, modified maleic oil type, modified alkyd type and polybutadiene type ones, and examples of cationic electrodeposition coating liquid include epoxy type ones.

In addition, pigments used for forming the colored transparent electrodeposition coating film should be uniformly electrodeposited on the article together with the resin components and therefore, the pigments may be organic ones which can be ionized in water and have good compatibility with or affinity for the resin components. Examples thereof preferably used herein are azo type, phthalocyanine type, metal complex type, triphenylmethane type, quinacridone type, perylene type, isoindolenone type, dioxazine type, quinophthalone type, vat dye type and condensed azo type ones. These organic pigments are preferably used in the electrodeposition coating liquid in an amount ranging from 0.1 to 15 g/l.

Each of the essential elements of the method for producing a corrosion-resistant article of a magnesium material having the gloss and color tone of the metal substrate surface has been described in detail hereinbefore. The corrosion-resistant article of a magnesium material having the gloss and color tone of the metal substrate surface according to the present invention can be prepared by such a production method. If a colorless transparent electrodeposition coating film is formed on the anodic oxide film, the corrosion-resistant article of a magnesium material according to the present invention possesses the gloss and color tone of the metal substrate surface almost identical to that of the original magnesium substrate surface, while if a colored electrodeposition coating film is deposited on the anodic oxide film, the corrosion-resistant article of the magnesium material has color tone of the metal substrate surface of the magnesium material only slightly changed, but has the gloss thereof. Moreover, the corrosion-resistant article of the magnesium material according to the present invention is substantially excellent in the corrosion resistance as compared with the article which is directly subjected to electrodeposition coating without any anodization treatment and the former is also excellent in the gloss and color tone of the metal substrate surface.

Specific examples of such articles of magnesium materials include cases for MD recording and reproducing device known as MD Walkman (registered trademark) and digital video cameras, bags, suitcases, interior and exterior parts for motorcars and two-wheeled vehicles, and welfare-related goods such as wheelchairs and sticks.

The present invention will be described in more detail below with reference to the following Examples.

EXAMPLE 1

An AZ91D diecast plate (50mm×50mm×3 mm) was mechanically polished to form a diecast plate having a mirror-finished surface, followed by washing the mirror-finished surface using a surfactant and then washing with water. On the other hand, there was separately prepared an electrolyte containing 25 g/l of trisodium phosphate dodecahydrate, 25 g/l of sodium aluminate and 10 g/l of glycerin and having a pH value of 13.0, followed by immersing the foregoing washed diecast plate in the electrolyte while maintaining the temperature thereof at 30° C. and carrying out DC electrolysis at an electrolysis voltage of 65 V for 30 seconds. The plate was washed with water, then subjected to a sealing treatment by immersing it in pure water maintained at 90° C. for 5 minutes and dried. The thickness of the anodic oxide film formed on the diecast plate which had thus been anodized and then subjected to the sealing treatment was determined according to the ellipsometry and was found to be 60 nm.

The diecast plate thus subjected to the anodization treatment was then subjected to electrodeposition coating under the following electrodeposition conditions.

Acrylic Anion Electrodeposition Coating Liquid Used:

Ellecoat AM [trade name of a product of Shimizu K.K.] diluted ½ time with ion-exchange water;

pH Value of the Electrodeposition Coating Liquid: 8.0;

Bath Temperature of the Electrodeposition Coating Liquid: 25° C.;

Electrodeposition Coating Voltage: 50 V;

Electrodeposition Coating Time: 30 seconds;

Material for Cathode: SUS304 stainless steel;

Cathode Bag: cotton flannel;

Electrode Ratio: Anode/Cathode=1/1;

Distance Between Electrodes: 15 cm; and

Stirring Means: stirring through circulation by a pump.

The diecast plate which had been subjected to electrodeposition coating under the foregoing electrodeposition conditions was washed with water, then pre-dried in a dryer in the air at 80° C. for 10 minutes and thereafter fired at 150° C. for 30 minutes in a firing furnace in the air.

The diecast plate which had simply been subjected to mirror-finishing and washing (diecast plate A); the diecast plate A which had been anodized and subjected to a sealing treatment, but free of any electrodeposition coating (diecast plate B); and the diecast plate A which had been anodized, subjected to a sealing treatment and then electrodeposition-coated (diecast plate C) were visually inspected for the surface gloss and color tone and the results obtained were compared with one another, but any significant difference was not observed at all.

The corrosion resistance of the diecast plate B, i.e., the diecast plate having an anodic oxide film and free of any electrodeposition coating layer was tested by repeating the cycle comprising salt spraying for 8 hours and allowing to stand for 16 hours, two times and evaluating its corrosion resistance according to the rating number method. As a result, the rating number (RN) thereof was found to be 9.0.

On the other hand, the corrosion resistance of the diecast plate C, i.e., the diecast plate which had been anodized, then subjected to a sealing treatment and further electrodeposition-coated was tested by repeating the cycle comprising salt spraying for 8 hours and allowing to stand for 16 hours, two times and evaluating its corrosion resistance according to the rating number method. As a result, the rating number (RN) thereof was found to be 10.0.

EXAMPLE 2

The same procedures used in Example 1 were repeated except for using pink-colored Ellecoat Color [trade name of a product of Shimizu K.K.] as the acrylic type anionic electrodeposition coating liquid and then the resulting diecast plates were compared to one another, inspected for the gloss and color tone as well as the corrosion resistance according to the same method used in Example 1.

The diecast plate which had simply been subjected to mirror-finishing and washing (diecast plate D); the diecast plate D which had been anodized and subjected to a sealing treatment, but free of any electrodeposition coating (diecast plate E); and the diecast plate D which had been anodized, subjected to a sealing treatment and then electrodeposition-coated (diecast plate F) were visually inspected for the surface gloss and color tone and the results obtained were compared with one another. As a result, it was fount that any significant difference in the gloss was not observed at all. Regarding the color tone of the diecast plates, however, the appearance of the diecast plate F having an electrodeposition coating layer slightly got colored pink.

The corrosion resistance of the diecast plate E, i.e., the diecast plate having an anodic oxide film and free of any electrodeposition coating layer was tested by repeating the cycle comprising salt spraying for 8 hours and allowing to stand for 16 hours, two times and evaluating its corrosion resistance according to the rating number method. As a result, the rating number (RN) thereof was found to be 9.0.

On the other hand, the corrosion resistance of the diecast plate F, i.e., the diecast plate which had been anodized, then subjected to a sealing treatment and further electrodeposition-coated was tested by repeating the cycle comprising salt spraying for 8 hours and allowing to stand for 16 hours, two times and evaluating its corrosion resistance according to the rating number method. As a result, the rating number (RN) thereof was found to be 10.0.

Comparative Example 1

An AZ91D diecast plate (50mm×50mm×3 mm) was mechanically polished to form a plate having a mirror-finished surface, followed by washing the mirror-finished surface using a surfactant and then washing with water. The diecast plate thus treated was subjected to electrodeposition coating under the same electrodeposition conditions used in Example 1, washed with water, then pre-dried in a dryer in the air at 80° C. for 10 minutes and thereafter fired at 150° C. for 30 minutes in a firing furnace in the air.

The gloss and color tone of the diecast plate surface thus obtained were dimmed as compared with the gloss and color tone of the diecast plate surface obtained in Example 1.

Moreover, the corrosion resistance of the diecast plate thus prepared was tested by repeating the cycle comprising salt spraying for 8 hours and allowing to stand for 16 hours, two times and evaluating its corrosion resistance and as a result, it was found that the diecast plate was corroded crumbly and that the diecast plate was thus inferior in corrosion resistance.

Industrial Applicability

The article of a magnesium material according to the present invention has the gloss and color tone of the metal substrate surface of the magnesium material or has the gloss of the metal substrate surface while accompanying almost no change in the gloss and is quite excellent in corrosion resistance. Therefore, the article of the present invention can be used in, for instance, cases for MD recording and reproducing device known as MD Walkman (registered trademark) and digital video cameras, bags, suitcases, interior and exterior parts for motorcars and two-wheeled vehicles, and welfare-related goods such as wheelchairs and sticks.

What is claimed is:

1. A corrosion-resistant article of a magnesium material having the gloss of the metal substrate surface, comprising an anodic oxide film formed on the external surface of an article of magnesium or a magnesium alloy by immersing the magnesium or magnesium alloy in an electrolyte containing both a phosphate and an aluminate to thus anodize the surface thereof, which never changes the gloss of the metal substrate, and a colorless or colored transparent electrodeposition coating film on the anodic film, the anodic oxide film having a thickness of not more than 0.1 micron.

2. The corrosion-resistant article of a magnesium material having the gloss of the metal substrate surface as set forth in claim 1 wherein the anodic oxide film is one obtained by immersing magnesium or a magnesium alloy in an electrolyte containing a phosphate, an aluminate and a bath stabilizer consisting of a hydroxyl group-containing organic compound to thus anodize the surface thereof.

3. The corrosion-resistant article of a magnesium material having the gloss of the metal substrate surface as set forth in claim 1 wherein the electrolyte has a pH value of not less than 12.

4. The corrosion-resistant article of a magnesium material having the gloss of the metal substrate surface as set forth in claim 1 wherein a temperature of the electrolyte is adjusted to the range of from room temperature to 50° C.

5. A method for preparing a corrosion-resistant article of a magnesium material having the gloss of the metal substrate surface, comprises the steps of immersing an article of magnesium or a magnesium alloy in an electrolyte containing a phosphate and an aluminate to thus form an anodic oxide film of a thickness of not more than 0.1 micron through anodization of the surface of the article and forming a colorless or colored transparent electrodeposition coating film on the anodic film through electrodeposition coating.

6. The method for preparing a corrosion-resistant article of a magnesium material having the gloss of the metal substrate surface as set forth in claim 5 wherein the concentration of the phosphate ranges from 0.05 to 0.2 M and the concentration of the aluminate ranges from 0.2 to 1 M.

7. The method for preparing a corrosion-resistant article of a magnesium material having the gloss of the metal substrate surface as set forth in claim 5 wherein after the anodization treatment, the article is subjected to a sealing treatment by immersing it in hot water and then the article is electrodeposition coated.

8. The method for preparing a corrosion-resistant article of a magnesium material having the gloss of the metal substrate surface as set forth in claim 5 wherein the electrolyte has a pH value of not less than 12.

9. The method for preparing a corrosion-resistant article of a magnesium material having the gloss of the metal substrate surface as set forth in claim 5 wherein a temperature of the electrolyte is adjusted to the range of from room temperature to 50° C.

10. A method for preparing a corrosion-resistant article of a magnesium material having the gloss of the metal substrate surface, comprises the steps of immersing an article of magnesium or a magnesium alloy in an electrolyte containing a phosphate, an aluminate and a bath stabilizer consisting of a hydroxyl group-containing organic compound to thus form an anodic oxide film of a thickness of not more than 0.1 micron through anodization of the surface of the article and forming a colorless or colored transparent electrodeposition coating film on the anodic film through electrodeposition coating.

11. The method for preparing a corrosion-resistant article of a magnesium material having the gloss of the metal substrate surface as set forth in claim 10 wherein the concentration of the phosphate ranges from 0.05 to 0.2 M, the concentration of the aluminate ranges from 0.2 to 1 M and the concentration of the bath stabilizer ranges from 1 to 20 g/l and 10 to 50% by weight on the basis of the weight of the aluminate.

12. The method for preparing a corrosion-resistant article of a magnesium material having the gloss of the metal substrate surface as set forth in claim 10 wherein after the anodization treatment, the article is subjected to a sealing treatment by immersing it in hot water and then the article is electrodeposition coated.

13. The method for preparing a corrosion-resistant article of a magnesium material having the gloss of the metal substrate surface as set forth in claim 10 wherein the electrolyte has a pH value of not less than 12.

14. The method for preparing a corrosion-resistant article of a magnesium material having the gloss of the metal substrate surface as set forth in claim 10 wherein a temperature of the electrolyte is adjusted to the range of from room temperature to 50° C.

* * * * *